US005952927A

United States Patent [19]

Eshman et al.

[11] Patent Number: 5,952,927

[45] Date of Patent: Sep. 14, 1999

[54] PORTABLE CHILD SAFETY ALARM SYSTEM

[76] Inventors: Richard Eshman, 8453 Parkland, Detroit, Mich. 48239; Keith Wissman, 417 Hendric Boulevard, Royal Oak, Mich. 48067; James Suchoski, 21788 McCormick, Detroit, Mich. 48236

[21] Appl. No.: 09/088,799

[22] Filed: Jun. 2, 1998

[51] Int. Cl.[6] ..... G08B 23/00

[52] U.S. Cl. ..... 340/573.4; 340/693.9

[58] Field of Search ..... 340/573.4, 573.1, 340/572.1, 572.5, 693.5, 693.9, 693.11

[56] References Cited

U.S. PATENT DOCUMENTS

| | | | |
|---|---|---|---|
| 4,095,214 | 6/1978 | Minasy | 340/573.4 X |
| 4,136,338 | 1/1979 | Antenore | 340/573.4 X |
| 4,598,275 | 7/1986 | Ross et al. | 340/573.4 |
| 4,682,155 | 7/1987 | Shirley | 340/573.4 |
| 4,684,933 | 8/1987 | Dill | 340/573.4 |
| 4,853,692 | 8/1989 | Wolk et al. | 340/573.4 X |
| 4,899,135 | 2/1990 | Ghahariiran | 340/573.4 |
| 5,047,750 | 9/1991 | Hector | 340/573.4 |
| 5,079,541 | 1/1992 | Moody | 340/573.4 |
| 5,115,223 | 5/1992 | Moody | 340/573.4 X |
| 5,119,072 | 6/1992 | Hemingway | 340/573.4 X |
| 5,473,310 | 12/1995 | Ko | 340/573.6 X |
| 5,557,259 | 9/1996 | Musa | 340/573.4 |

*Primary Examiner*—Thomas Mullen
*Attorney, Agent, or Firm*—Howard & Howard

[57] ABSTRACT

A portable child safety alarm system 10 comprising an indicator tab 12 for affixation to a child, a detector 14 for detecting either the presence or the absence of the indicator tab 12 and thereby producing a detector signal. An alarm 16 responsive to the detector signal, a battery 18 for powering the detector 14 and the alarm 16 are enclosed within a portable housing 20 having a mounting member 22 dedicated to mounting the housing 20 on a support structure thereby allowing the system to be easily relocated to redefine the specified secure area.

5 Claims, 1 Drawing Sheet

PORTABLE CHILD SAFETY ALARM SYSTEM

BACKGROUND OF THE INVENTION

1. Field of the Invention

The present invention relates to a system for detecting the movement of a child from a secure area. More particularly, the portable child safety alarm includes a mobile detection module having a mounting member allowing the system to be easily relocated to either an indoor or outdoor location to thereby redefine the specified secure area.

2. Description of the Prior Art

Electronic detection systems are well known in the prior art and have been applied to diverse applications. Electronic detection systems, as have been applied to humans, usually include an indicator tag attached to a child to be detected, and detection modules positioned adjacent passageways for detection of the unauthorized passage of the child.

Hector, U.S. Pat. No. 5,047,750, and Moody, U.S. Pat. No. 5,079,541, disclose systems for preventing the unauthorized removal of an infant from a hospital or similar setting. Detection modules are positioned at an ingress or egress of the secured nursery area to detect the passage of an indicator tag. When an infant wearing the indicator tag on his or her diaper passes through an exit guarded by the detection modules, an alarm is triggered to notify hospital personnel.

The prior art detection modules, however, are normally of substantial size and are intended to be positioned adjacent to the protected passageways. The detection modules bracket the passageway, and are permanently affixed to the floor. The permanency of the detection modules prevent the expeditious relocation of the secured area. Further, the detection modules must be duplicated at every location in which a secured area is desired. Although suitable for their intended purpose, the combination of these factors prevents the applicability of such a system to a residential environment.

SUMMARY OF THE INVENTION AND ADVANTAGES

A portable child safety alarm system comprising an indicator tab for affixation to a child, a detector for detecting one of the presence and the absence of the indicator tab then producing a detector signal. A portable housing encloses the detector, the alarm responsive to the detector signal, and a battery for powering the detector and the alarm. The housing is characterized by having a mounting member dedicated to mounting the housing on a support structure.

Accordingly, the present invention provides a portable child safety alarm, wherein the housing enclosing the detector may be mounted in any indoor or outdoor location to define a secure area in which a child is to be excluded from, or limited to. In action, the present invention provides a portable detection system which allows the expeditious relocation of the secured area in an unobtrusive manner within a residential environment.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
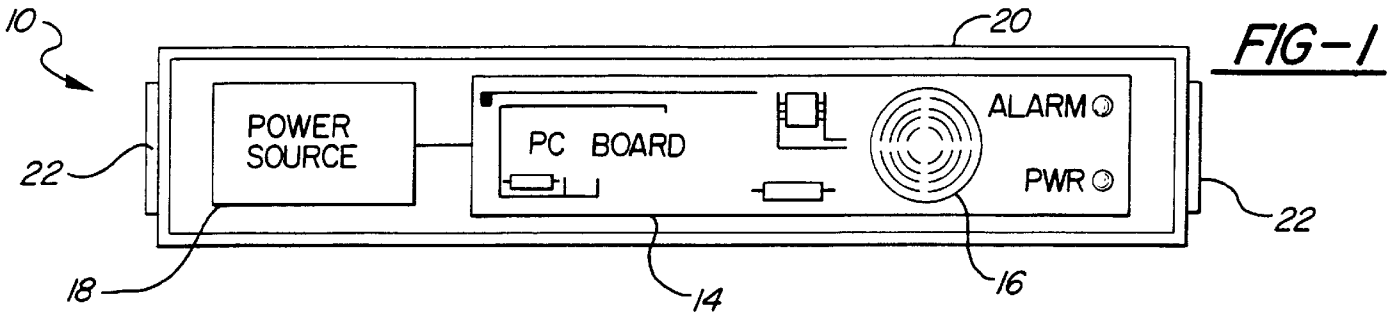
FIG. 1 is an isometric view of the portable child safety alarm system of the present invention.
Figure 2:
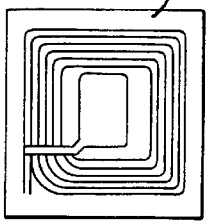
FIG. 2 is an isometric view of an indicator tab for use with the portable child safety alarm system in one of the embodiments of the present invention.

Referring to the Figures, wherein like numerals indicate like or corresponding parts throughout the several views, a portable child safety alarm system is generally shown at 10 in FIG. 1. The portable child safety alarm system 10 of the present invention includes an indicator tab 12 for affixation to a child and a detector 14 for detecting either the presence or the absence of the indicator tab 12. As shown in FIG. 2, the indicator tab 12 is operable with the detector 14 and is preferably a commercially available passive resonant frequency tuned coil sensor. These indicator tabs are known in the art and may be located within a garment of a child or a bracelet for the child to wear.

When the detector 14 detects either the presence or the absence of the indicator tab 12, the detector 14 produces a detector signal. An alarm 16 responsive to the detector signal is thereby triggered. The alarm 16 preferably emits an audible and/or a visual signal providing notification that a child having an indicator tab 12 has entered, or is leaving a secured area defined by the detector 20. The audible and/or visual signal may be further tailored to provide a specific signal responsive to the secured area in which the child has entered or has left. The signal may provide for different colored lights or sounds to so indicate the specified secure area. Further, the signal may be relayed to a personal remote notification device such as a pager which is worn by a responsible person.

A battery 18 for powering the detector 14 and the alarm 16 is enclosed within a housing 20 providing a self contained unit. As discussed in greater detail below, the usage of a battery 18 provides a portable child safety alarm system 10 which is not constrained by power outlets and their associated extension cords.

Figure 3:
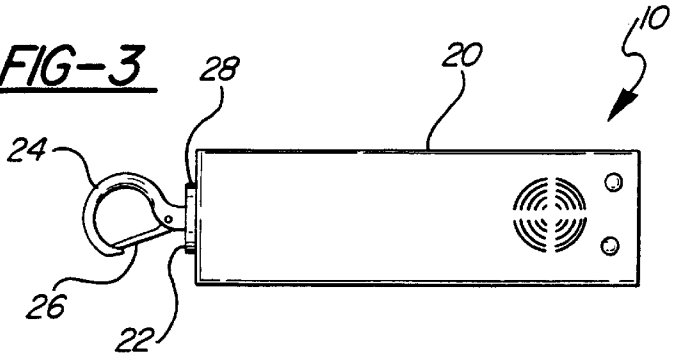
FIG. 3 is an isometric view of the portable child safety alarm system in one of the embodiments of the present invention.

The housing 20 further includes a mounting member 22 dedicated to mounting the housing 20 on a support structure. As shown in FIG. 3, the mounting member 22 preferably includes a hook 24 for hangedly mounting the housing 20. The hook 24 provides convenient mounting of the housing 20 to any available support structure to define a secure area in which a child is to be excluded from, or limited to. The hook 24 is especially convenient in a residential environment wherein the housing 20 may be easily relocated from one area to another. The hook 24 preferably includes a lock 26 to prevent tampering and a swivel joint 28 allowing the hook 24 to swivel and provide further mounting possibilities.

Figure 4:
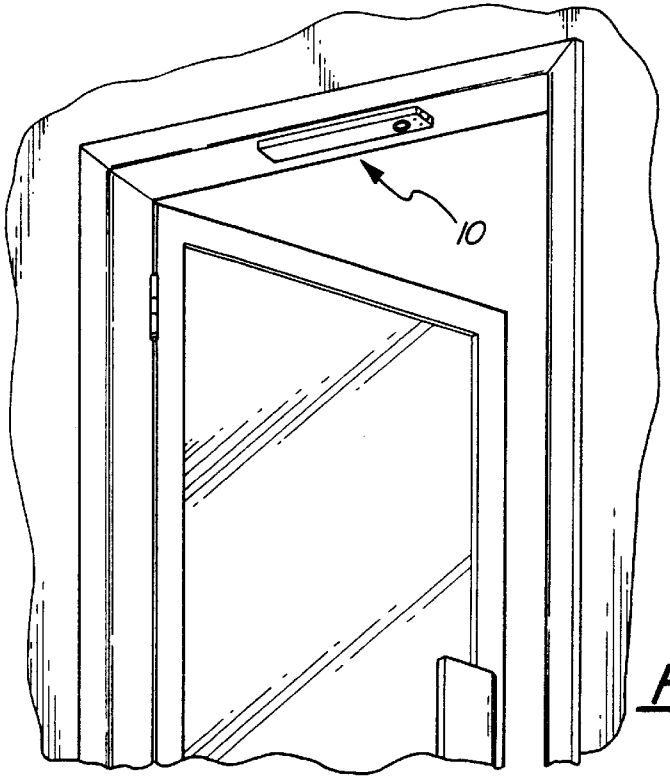
FIG. 4 is a pictorial representation of a passageway equipped with the portable child safety alarm system of the present invention.

The mounting member 22 may further include attachment means for mounting the housing 20 to a flat surface. The attachment means may include, but are not limited to, such devices as: adhesives, hook and loop material, or removable clips. Such attachment means provide for an advantageous and unobtrusive mounting location either indoor or outdoor as depicted in FIG. 4.

The invention has been described in an illustrative manner, and it is to be understood that the terminology which has been used is intended to be in the nature of words of description rather than of limitation.

Obviously, many modifications and variations of the present invention are possible in light of the above teachings. It is. therefore, to be understood that within the scope of the appended claims, wherein reference numerals are merely for convenience and are not to be in any way limiting, the invention may be practiced otherwise than as specifically described.

What is claimed is:

1. A portable child safety alarm system (10) comprising:

an indicator tab (12) for affixation to a child, a detector (14) for detecting one of the presence and the absence of said indicator tab (12) and producing a detector signal, an alarm (16) responsive to said detector signal, a battery (18) for powering said detector (14) and said alarm (16), a housing (20) for enclosing said battery (18), said detector (14) and said alarm (16), and said housing (20) characterized by having a hook (24) for hangedly mounting said housing (20) on a support structure.

2. A system as set forth in claim 1 wherein said hook (24) includes a lock (26).

3. A system as set forth in claim 2 including a swivel joint (28) to allow said hook (24) to swivel.

4. A system as set forth in claim 2 wherein said alarm (16) emits an audible signal.

5. A system as set forth in claim 4 wherein said alarm (16) emits a visible signal.

* * * * *